United States Patent [19]

Alen et al.

[11] Patent Number: 4,853,084

[45] Date of Patent: Aug. 1, 1989

[54] METHOD FOR CONTROLLING ALKALINE PULPING PROCESS

[76] Inventors: Raimo Alen, Ratamestarinkatu 13 A 17, SF-00520 Helsinki; Eero Sjöstrand, Pitkänkalliontanhau 3 D 14, SF-02170 Espoo, both of Finland

[21] Appl. No.: 23,994

[22] Filed: Mar. 9, 1987

Related U.S. Application Data

[63] Continuation of Ser. No. 818,101, Jan. 9, 1986, abandoned.

[30] Foreign Application Priority Data

Jan. 17, 1985 [FI] Finland ..... 850208

[51] Int. Cl.[4] ..... D21C 3/02; D21C 7/12

[52] U.S. Cl. ..... 162/49; 162/61

[58] Field of Search ..... 162/49, 76, 61, 62, 162/238, DIG. 10

[56] References Cited

PUBLICATIONS

Kleinert et al., "Short Wavelength Ultraviolet Absorption of Alkali-Lignin; a Means of Control in Kraft Cooking . . . "; *TAPPI,* vol. 41(7), p. 372; 7-1958.

Kleinert et al., "Short Wavelength Ultraviolet Absorption of Various Lignins and Related Substances", Pulp and Paper Magazine of Canada, p. 154, Apr. 1957.

Aronovic et al., "Determination of Low Molecular Weight Organic Acids in Pulping Liquors", *TAPPI,* vol. 54(10), p. 1693, Oct. 1971.

*Primary Examiner*—Steve Alvo

*Attorney, Agent, or Firm*—Andrus, Sceales, Starke & Sawall

[57] ABSTRACT

A method for controlling the alkaline delignification processes, especially the sulphate process of wood or other materials containing cellulose by the interdepending concentrations of the hydroxymonocarboxylic acids which are formed in the process and dissolved into the waste liquor. According to the method a sufficient number of representative waste liquor samples are taken during the process and the acids present in the samples are analyzed by gas chromatography. Thus, the required time interval for achieving the desired cooking stage can be determined by using the interdepending ratios of the concentrations of certain acids.

3 Claims, 3 Drawing Sheets

METHOD FOR CONTROLLING ALKALINE PULPING PROCESS

This is a continuation of application Ser. No. 818,101, filed Jan. 9, 1986, now abandoned.

BACKGROUND OF THE INVENTION

The present invention relates to a method for controlling alkaline pulping process, especially the sulphate process of pine and birch, by utilizing the relative composition of the alifatci acids dissolved into the cooking liquid.

In alkaline pulping processes the lignin which is present in the raw material of wood and bonds the fibers of cellulose together is removed under strongly alkaline circumstances, at which spliting of the polymeric carbohydrates, cellulose and hemicellulose takes place, which reduces the overall yield (Sjöström, E., Wood Chemistry, Foundamentals and Applications, Academic Press, New York, 1981). Thus, the organic ingredients, dissolved into the waste liquor, consist of the substances extracted from wood and, in addition, of the disintegration products of lignin as well as of the aliphatic acids formed as a result of the spliting reactions taking place within the carbohydrate chains.

The fraction of alifatic acids, included in the waste liquor consists of evaporable acids (formic and acetic acids) as well as hydroxymonocarboxylic and hydroxydicarboxylic acids (Alen, R., Neimelä, K. and Sjöström, E., J. Chromatogr. 301 (1984) 273). The hydroxymonocarboxylic acids of the compounds mentioned above form the most significant fraction of acids present in the waste liquor and it has been concluded that over 20 various compounds belong to this group of acids. The total number of the acids formed in the hard wood pulping process is similar to that formed in the soft wood pulping process, but the relative proportions of the acids differ somewhat from each other. In addition, the cooking circumstances applied in each pulping process have an effect upon the acid contents in question. The formation of acids in the pulping process has been studied to some extent (Malinen, R. and Sjöström E., Paperi Puu 57 (1975) 728, Niemelä, K., Alen, R. and Sjöström, E., Holzforschung (1985) under print), at which differences in the formation rates of the acids have been detected, as a concequence of which the acid compositions in the waste liquor will change during the progress of the delignification process.

SUMMARY OF THE INVENTION

According to the method of the present invention the alkaline pulping process, especially the sulphate cooking processes of pine and birch, can be controlled by using the relative compositions of the hydroxymonocarboxylic acids formed in the cooling liquor during a certain period of time, at which it is possible to anticipate the time taken to reach the desired degree of delignification during the cooking circumstances in question. The principal characteristics of the invention are presented in the inclosed patent claims.

During the development of the method of the invention it became evident that between interdepending concentrations of the significant monocarboxylic acids (or the proportions of concentrations) and the total yield of the pulping process (or alternatively the ligning residue in the raw material) could be determined certain arithmetically presentable linear relationships depending on the degree of delignification in the cooking process.

If samples are taken at predetermined time intervals during the pulping process (for example, when the temperature is rised and immediately thereafter), then the necessary time for reaching the desired cooking stage can be determined by the acid contents in question.

The concentrations of hydroxyacids can be determined fairly quickly by a gas choromatographic method (Alen, R., Niemelä, K. and Sjöström, E., J. Chromatogr. 301 (1984) 273), at which the acids are separated from each other as separately prepared derivates of trimethylsilyl (TMS-derivatives). Thus, the corresponding acid concentrations (based upon the areas of the chromatographic peaks) can be obtained and the control information for the pulping process can be calculated from the acid concentrations immediately by utilizing computer technology. The temperature of the separation column (capilar column) used in the gas chromatographic analysis is controlled so that a clear separation between the peaks resulting from the concentrations of the significant acid derivatives (the TMS-derivatives of glycolic acid, lactic acid, 2-hydroxybutanoic acid, 3,4-dideoxypentonic acid, anhydroisosaccharine acid, 3-deoxyerythro- and pentonic- as well as alpha- and beta-glucoisosaccharine acids) can be obtained. In order to determine the necessary delignification time, the interdepending changes of the concentrations of said acids during the pulping process are observed.

DESCRIPTION OF THE ILLUSTRATED EMBODIMENT

In the following examples the method, to which the invention relates, is illustrated more specifically. Although only pine and birch sulphate pulping process have been considered in the examples, the method can be adapted to use in all kinds of alkaline pulping processes (for example in soda, AQ pulping processes) if the corresponding interdepending formation of the acids mentioned above is determined in each case with respect to the total yield of the pulping process and with respect to the degree of lignin dissolved (for example by determining the chlorine number of the pulp).

EXAMPLE 1

Figure 1:
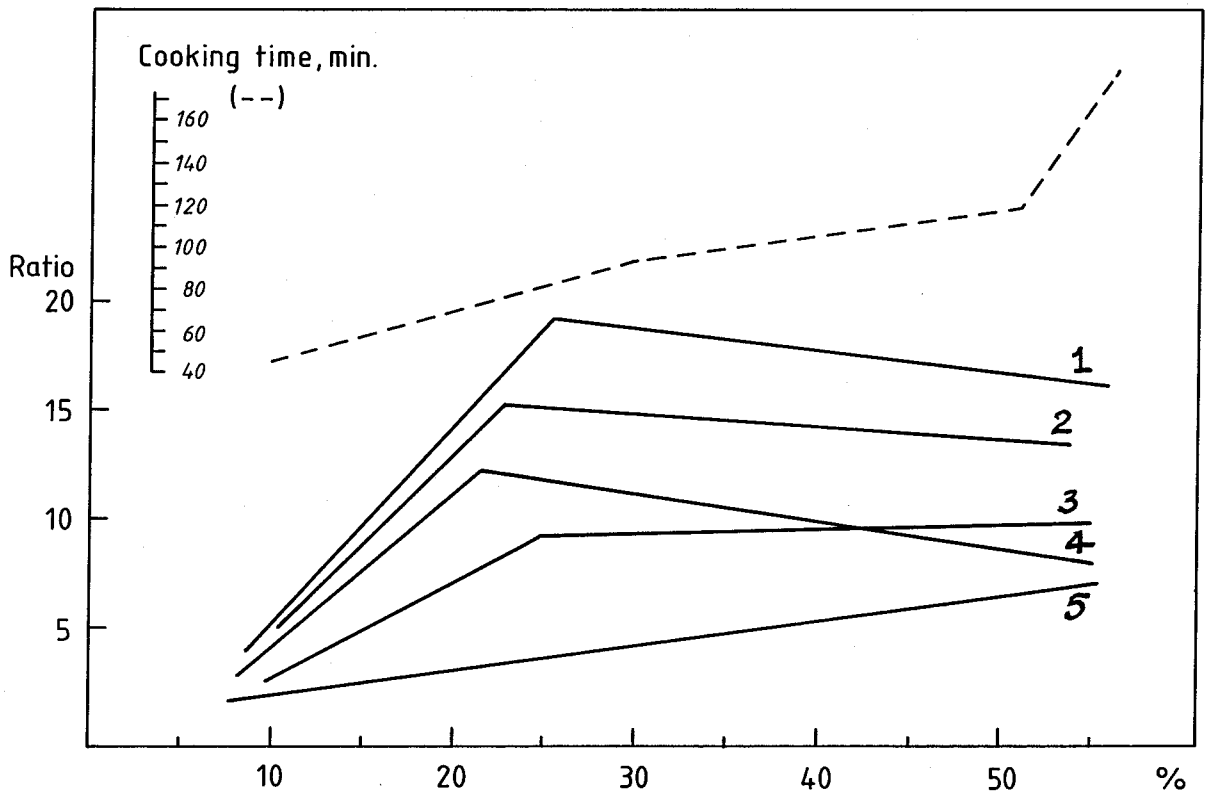
FIG. 1 shows the change of the interpending concetrations of certain alifatic acids which will be formed during the sulpate pulping process of pine and dissolved in the waste liquor shown as functions of the amounts of substances dissoved during a pulping process; ratios: 1 (alpha-glucoiso-saccharine acid)/(4-deoxythereopentone acid), 2(alpha and beta-glucoisosaccharine acids)/(xyloisosaccharine and anhydroisosaccharine acids), 3 (3,4-dideoxypentonic acid)/(anhydroisosaccharine acid), 4 (lactic acid)/(glycolic acid) and 5 /beta glucoisosaccharine acid)/(3-deoxyerythropentonic acid.

Pine (Pinus sylvestris) chips (screened fraction from 2 to 4 mm) were cooked according to a normal sulphate pulping process (effective alkaline content 22% (as NaOH) calculated on wood basis; sulphidity 30%) in a laboratory cooking apparatus with a liquid/wood ration of 3,5 L/kg. In the process the temperature was rised at a steady rate during 90 minutes (from 20° C.) up to 170° C. and cooking was continued for 90 minutes at the maximum temperature. Waste liquor samples were taken at certain time intervals (10 minutes) during the process and the relative composition of the fractions of hydroxy acids, was analysed from the samples. FIG. 1 shows the dependancy of the relative ratios of the composition of the fraction of the hydroxy acids with respect to the total yield of the process achieved during the corresponding time interval. In addition, the delignification time has been observed in the results.

Figure 2:
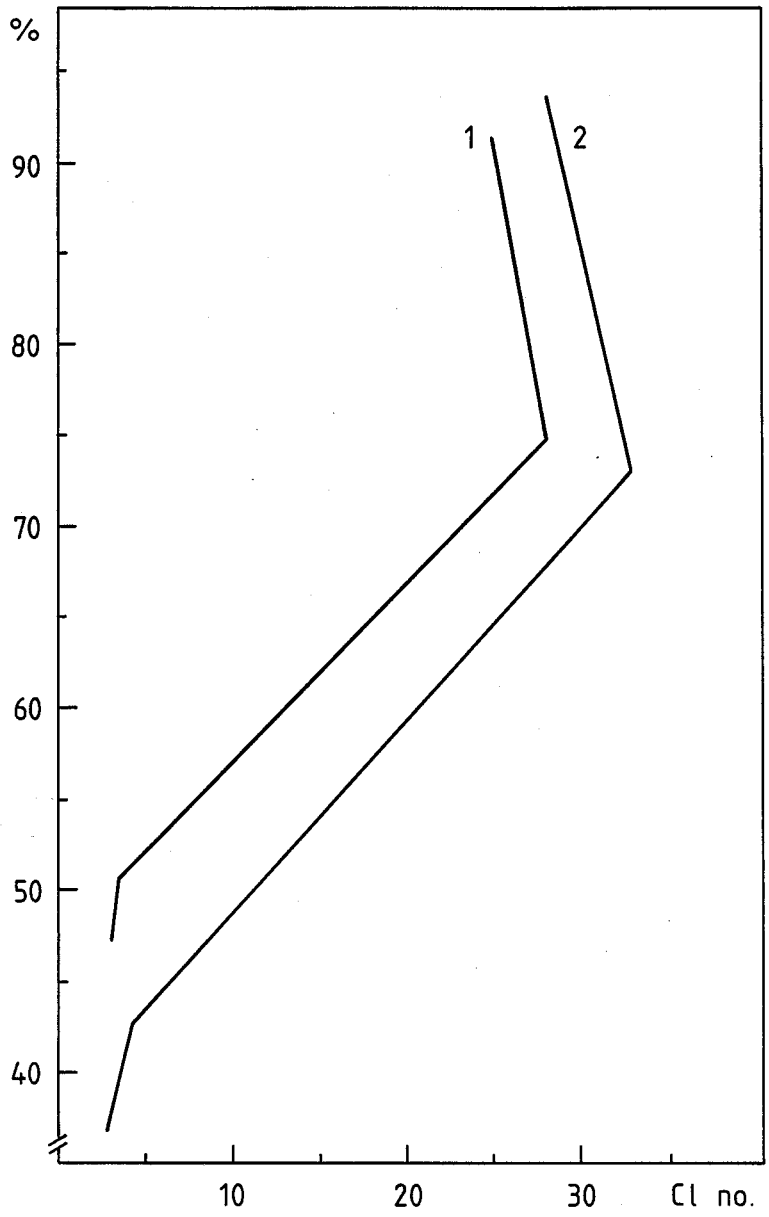
FIG. 2 shows the total yields as a function of the chlorine number of the pulp in some pulping processes: sulphate boiling processes of 1 birch and 2 pine.

FIG. 2 shows the dependency of the total yield upon the chlorine number, by which the amount of lignin present in the pulp can be calculated in each case. The involved kappa numbers at yields of 48.3, 47.9, 45.1, 44.7, and 44.1% were 71.5, 45.7, 37.2, 32.5, and 26.4 resp.

When a sufficient number (4–6) of liquor samples are taken during the temperature rise and immediately thereafter, the cooking time for achieving the desired cooking stage can be determined mathematically (the results during the cooking process are continuously compared to the reference process) by using the information presented in FIGS. 1 and 2. Naturally, it is possible to choose other acid ratios for the basis of the examination, although their number must be chosen correspondingly. The gas chromatographic analysis and the preparation of samples was carried out according to the article (Alen, R., Niemelä, K. and Sjöström, E., J. Chromatogr. 301 (1984) 273) mentioned above. However, if required the gas chromatographic temperature program can be accelerated without impairing significantly the distinctivity of the peaks.

EXAMPLE 2

Figure 3:
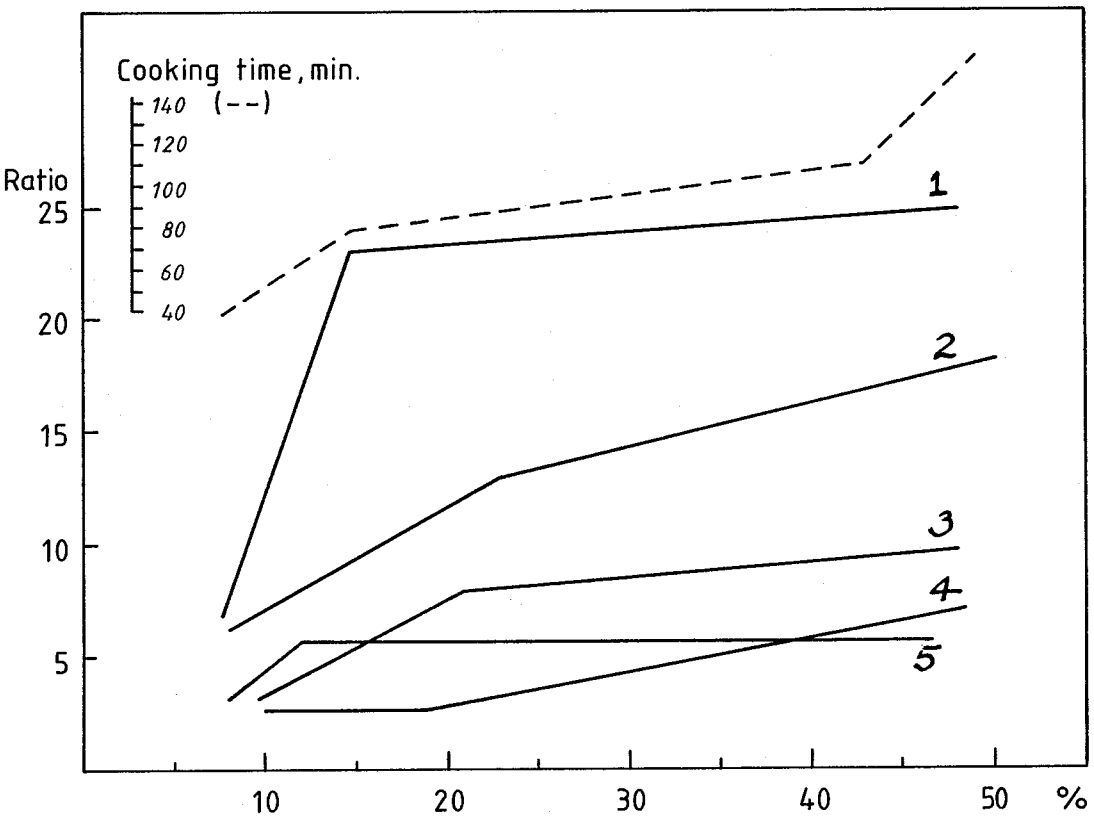
FIG. 3 shows the change of the interdepending concentrations of certain alifatic acids which were formed during the sulphate pulping process of birch and dissolved in the waste liquor shown as functions of the amounts of substances dissoved during the pulping process; ratios: 1(2-hydroxybutanoic acid), 2(lactic acid)/(3-deoxyerythropentonic acid), 3(2-hydrocybutanoic acid), 2(latic acid)/(3-deoxyerythropentonic acid), 3(2-hydroxybutanoic acid)/(3-deoxythreopentonic acid), 4, (lactic and glycolic acids)/(alpha glucoisosaccharine acid) and 5 (alpha and beta-glucoisosaccharine acids)/(3-deoxythereopentonic acid).

According to example 1 wood chips (sieved fraction from 2 to 4 mm) prepared from a birch (Betula verrucosa/B. pubescens) were cooked in a corresponding sulphate process (effective alkaline content 20% (as NaOH) of the wood; sulphidity 30%, liquid/wood ratio 3,5 L/kg) at which the temperature was rised at a uniform rate (from 20° C.) up to 168° C.. the information needed in the control of the process has been presented in FIGS. 2 and 3. The circumstances at analysis and the sampling method as well as the preparation of the samples was carried out according to the former example.

I claim:

1. A method of controlling an alkaline pulping process, comprising the steps of pulping cellulose material with an alkaline cooking liquor in a pulping process, said process being selected from the group consisting of a sulfate process and a soda anthraquinone process, determining at a plurality of time intervals the concentration ratios of at least two different hydroxymonocarboxylic acids formed during the pulping wherein the ratios change at various times during the pulping, and terminating the pulping when a predetermined concentration ratio of said two hydroxymonocarboxylic acids is reached.

2. The method of claim 1, wherein said acids are separated as trimethylsilyl derivatives and the concentration of said acids is determined by gas chromatography.

3. The method of claim 1, wherein said acid is selected from the group consisting of glycolic acid, lactic acid, 2-hydroxybutanoic acid, 3,4 dideoxypentonic acid, 3-deoxyerythro-pentonic acid, 3-dioxy-thereo-pentoic acid, xyloisosaccharinic acid, anhydroisoaccharinic acid, $\alpha$-glucoisosaccharinic acid, $\beta$-glucoisosaccharinic acid.

* * * * *

UNITED STATES PATENT AND TRADEMARK OFFICE

CERTIFICATE OF CORRECTION

PATENT NO. : 4,853,084

DATED : August 1, 1989

INVENTOR(S) : RAIMO ALEN et al

It is certified that error appears in the above-identified patent and that said Letters Patent is hereby corrected as shown below:

Cover page at "[76]" Cancel "EERO SJÖ STRAND" and substitute therefor ---EERO SJÖSTROM---

Signed and Sealed this

Sixteenth Day of April, 1991

*Attest:*

HARRY F. MANBECK, JR.

*Attesting Officer*

*Commissioner of Patents and Trademarks*